United States Patent [19]

Pino

[11] Patent Number: 4,996,725

[45] Date of Patent: Mar. 5, 1991

[54] RETRACTABLE GUARD FOR SEWAGE PIPES

[76] Inventor: Wilton J. Pino, 922 Sharp Rd., Baton Rouge, La. 70815

[21] Appl. No.: 536,020

[22] Filed: Jun. 11, 1990

Related U.S. Application Data

[63] Continuation-in-part of Ser. No. 376,291, Jul. 6, 1989, Pat. No. 4,932,080.

[51] Int. Cl.[5] ..... E03D 11/00

[52] U.S. Cl. ..... 4/257; 4/207; 4/292; 4/DIG. 14; 4/661; 210/445; 210/447

[58] Field of Search ..... 4/255-257, 4/300, 207, 661, 319, 653; 15/104.33, 104.31-104.32, 104.05, 104.03, 104.41, 104.061, 242; 138/44; 210/447, 435, 445

[56] References Cited

U.S. PATENT DOCUMENTS

| | | | |
|---|---|---|---|
| 2,506,669 | 5/1950 | Heuacker | 4/DIG. 14 |
| 4,051,042 | 9/1977 | Tuller | 4/DIG. 14 |
| 4,197,207 | 4/1980 | Rosaen et al. | 210/447 |
| 4,609,459 | 9/1986 | Hendrix | 210/445 |

FOREIGN PATENT DOCUMENTS

| | | | |
|---|---|---|---|
| 2756243 | 7/1979 | Fed. Rep. of Germany | 4/DIG. 14 |

*Primary Examiner*—Henry K. Artis

*Attorney, Agent, or Firm*—William David Kiesel; Robert C. Tucker

[57] ABSTRACT

A retractable guard for use in combination with a sewage pipe leading from a flush toilet is provided having a plurality of prongs with hooked ends positioned within a cross section of the pipe. The prongs are connected to a piston which is slidable within a cylinder, perpendicular to the pipe. Flushing the toilet causes water to be directed in the cylinder which in turn partially retracts the prongs. Water may be diverted from the cylinder to wash accumulated debris from the prongs.

16 Claims, 1 Drawing Sheet

RETRACTABLE GUARD FOR SEWAGE PIPES

This is a continuation-in-part of copending application Ser. No. 07/376,291 filed on July 6, 1989, now U.S. Pat. No. 4,932,080.

BACKGROUND OF THE INVENTION

1. Field of the Invention

This invention relates generally to a device placed in a sewer pipe to trap certain metal articles which may plug the pipe. In particular, this invention relates to a guard with self cleaning features having special applications to toilets in prisons and other correctional facilities.

2. Prior Art

The desirability of providing a guard in a drain pipe or sewer pipe to trap articles which would otherwise clog the pipe has long been recognized in the prior art. With regard to a sewer pipe leading from a toilet, the requirement of a guard is that the ordinary solids introduced into a toilet, excrement and tissue paper, should be allowed to pass unobstructed while articles not readily decomposed, such as cloth, diapers, sanitary napkins and plastic, should be trapped. The aforementioned requirement are particularly stringent in the prison setting. Prisoners are prone to introduce cloth and paper into the toilets with the intent that the prison sewage system be caused to fail. Especially damaging is cloth or other material which, even if it does not clog the pipes, is not broken down or digested in the treatment plant.

Another problem particular to the prison setting is the need to prevent various metal objects from being flushed through the prison sewage system. In many instances these metal objects will be homemade knives and other weapons that the prisoner is trying to dispose of in order to avoid being caught in possession of these prohibited devices.

Various stationary devices have been employed in sewer lines to trap undesirable articles as shown in the following U.S. patents.

| | |
|---|---|
| Lehmann | 2,693,603 |
| Click et al. | 2,811,724 |
| Sierzega | 3,904,523 |
| Halstad | 4,307,476 |

Several of these inventions disclose devices with hooks which are positioned in the sewer line. However, because these devices are stationary, there is a tendency for otherwise safe waste, especially toilet paper, to accumulate on the hooks. Eventually, the line plugs at the site of the guard device.

Devices which rotate within a pipe to scrape the interior of the pipe or pulverize solids have been employed with some success. Examples of rotating guards may be found in the following U.S. Pats.

| | |
|---|---|
| Hirrich | 1,217,763 |
| Peaden | 2,454,884 |
| Hirshstein | 2,627,610 |
| Moore | 3,439,361 |

In a prison setting, however, where material and garments are introduced into the sewage system, additional burdens are placed upon the comminuting devices. For example, even the most powerful in line device disclosed in the prior art would have difficulty pulverizing a bed sheet. In addition they would not be able to prevent the passage of certain metal objects that are commonly made by prisoners and used as weapons.

SUMMARY OF THE INVENTION

Therefore, one object of this invention is to provide a guard which will catch undesirable articles introduced into a sewer pipe without causing the pipe to plug up.

Another object of this invention is to provide a guard which catches certain metal articles near the point of their introduction to prevent disruption of the entire sewage system.

Another object of this invention is to provide a guard with self cleaning features.

Another object of this invention is to provide a guard which prevents trapped articles from plugging the sewer line by retracting during a flush of a toilet.

Another object of this invention is to provide a retractable guard which is operated by water pressure in response to a flush.

Accordingly, a plurality of magnetized prongs with hooked ends are disposed perpendicularly within a sewage pipe downstream of a toilet. The opposite ends of the prongs are connected to a piston which in turn is slidable within a cylinder connected to the pipe. Flushing the toilet opens a valve directing a flow of water into the cylinder thereby raising the piston and retracting the prongs. At the end of the flush cycle, the piston and prongs are urged back to their starting position. During the flush cycle, a portion of the flow of water directed into the cylinder is sprayed on the hooked ends of the prongs to clean them while they are retracted. The rates at which the prongs retract and extend are adjustable. For convenience in cleaning, the guard device is provided with a quick release connection which separates from the pipe with a 1/4 turn twist.

DESCRIPTION OF THE PREFERRED EMBODIMENT

Figure 1:
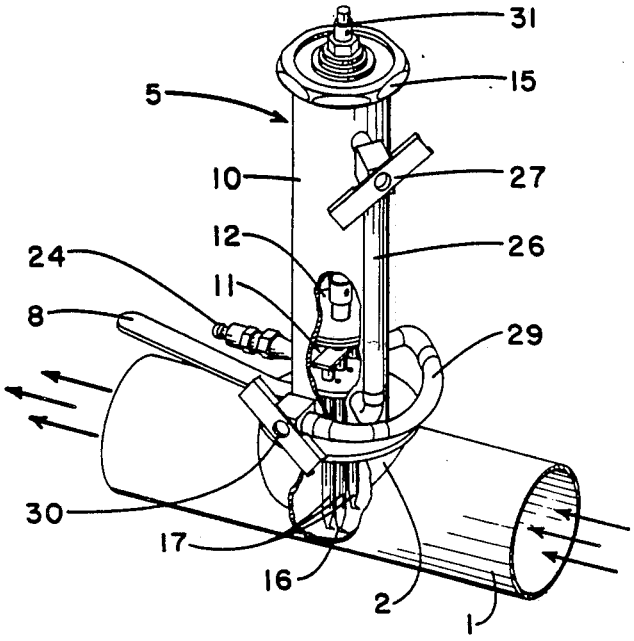
FIG. 1 is a perspective view of the guard with a cutaway showing internal parts.
Figure 2:
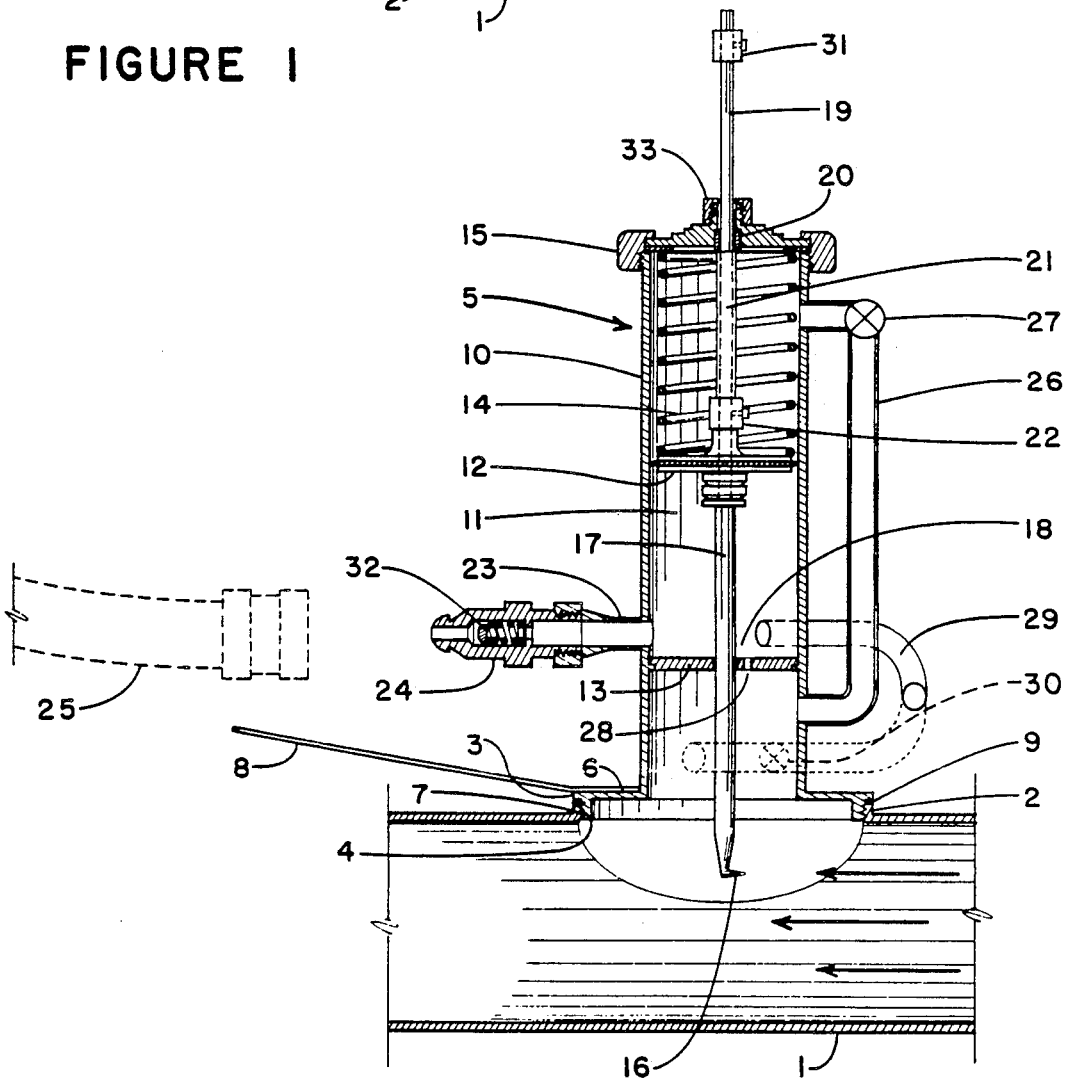
FIG. 2 is a side cross sectional view of the guard.

Without limiting the scope of the invention, the preferred embodiment of the invention is hereinafter set forth.

Sewage pipe 1 is located downstream from a flush toilet. Arrows indicate the direction sewage flows through pipe 1. The upper side of pipe 1 has been provided with tee 2 which is substantially perpendicular to pipe 1. End 3 of tee 2 is flat and has internal threads 4.

Guard 5 has base 6 with outer threads 7 to engage tee 2. Base 6 is provided with handle 8 to facilitate installation and removal. Gasket 9 is positioned between base 6 and end 3 of tee 2 to create a seal between the parts. In a preferred embodiment, guard 5 may be secured in place on pipe 1 with a quarter turn of handle 8.

Guard 5 has cylinder 10 attached to base 6. Cylinder 10 has chamber 11 defined by piston 12 at one end and plate 13 at the other end. Spring 14, positioned in cylinder 10 between cap 15 and piston 14, urges piston 12 downward. Cap 15 is threaded onto the top of cylinder 10.

Undesirable articles introduced into pipe 1 are caught by hooks 16 at the end of prongs 17. In a preferred embodiment, three prongs are used, but more or less may be employed. At least two of the prongs 17 should be magnetized so as to attach metal objects that pass through them. If more than three prongs are used then the adjacent prongs should be oppositely charged. Prongs 17 are attached at their upper end to the bottom side of piston 12. As piston 12 is driven upward, as will be described in greater detail below, prongs 17 are likewise raised. Prongs 17 slide through openings 18 in plate 13.

Piston 12 is stabilized by guide rod 19 which extends upward from piston 12 through bushing 20 and "O" ring 33 in cap 15. Sleeve 21 on guide rod 19 checks the upward travel of piston 12 when the upper end of sleeve 21 contacts cap 15. The distance travelled by piston 12 can be adjusted by raising and lowering set screw assembly 22 on guide rod 19, which in turn raises and lowers sleeve 21.

Piston 12 is driven by water under pressure entering chamber 11 via inlet 23. The water pressure of a municipal water supply is adequate to operate the guard. Typical municipal systems supply water at 50 to 80 pounds per square inch. Inlet 23 has adapter 24 so that guard 5 may be easily disconnected from water supply hose 25 for inspection and servicing. As mentioned earlier, guard 5 is threaded on to tee 2, requiring a quarter turn to be fully engaged. In a preferred embodiment, supply hose 25 is in communication with the flush valve of a toilet (not shown) and water is permitted to flow to inlet 23 only when the toilet is flushed. Valves which supply water for a certain period of time following activation are well known to those with skill in the art.

Inlet 23 is designed with a bore which will allow sufficient water in to chamber 11 to drive piston 12 without diverting water unnecessarily from the flush. Further, adapter 24 is provided with check valve 32 to allow water to only flow into chamber 11 through inlet 23.

As piston 12 travels upward, the air in cylinder 10 between piston 12 and cap 15 is compressed, offering resistance and slowing the rate of ascent of piston 12. Air relief line 26 is provided to control the release of air from cylinder 10 thereby allowing the rate at which piston 12 rises to be adjusted. Air relief line 26 connects the interior of cylinder 10 above piston 12 to the interior of cylinder 10 below plate 13. Valve 27 in air relief line 26 is manually adjustable. The rate of ascent of piston 12 will control the relative position of hooks 16 in pipe 1 during the flush cycle.

Part of the water flowing into chamber 11 is diverted out orifices 28 which are in plate 13 on the upstream side of prongs 17. Orifices 28 are positioned to direct a spray of water to clean prongs 17 as they are raised out of pipe 1 during a flush cycle. The spray from orifices 28 is intended to break up ordinary waste such as toilet paper which has become entrapped, without dislodging non-degradable waste such as clothing.

Water may also be diverted out of chamber 11 via water relief line 29 which connects chamber 11 and cylinder 10 below plate 13. at the end of each flush cycle, piston 12 is urged downward by spring 14 and the water in chamber 11 is expelled. If valve 30 of water relief line 29 is closed, piston 12 descends slowly as the water is forced out of orifices 28. Opening valve 30 diverts water out of chamber 11 causing piston 12 and prongs 17 to return quickly. Water relief line 29 also influences the rate at which piston 12 rises since water is diverted both during the upward and downward stroke of piston 12.

Prior to a flush cycle being initiated, prongs 17 are extended with hooks 16 positioned in the mainstream of pipe 1. The depth of hooks 16 can be adjusted with set screw assembly 31 which is threaded onto the top of guide rod 19. Flushing the toilet causes water to flow into inlet 23 and chamber 11. Piston 12 is forced upward while water is sprayed on prongs 17 and hooks 16 through orifices 28. If valve 30 is open, water will also be diverted via water relief line 29 into pipe 1. During the upstroke of piston 12, air in the top of cylinder 1 is forced out as previously described.

At the end of the flush cycle, hooks 16 have been raised toward the top of pipe 1. In a preferred embodiment, hooks 16 are not raised above the cross sectional stream defined by pipe 1. This prevents articles which are thrown in the toilet near the end of the flush cycle from escaping past the device. Should an article of clothing or the like be caught by hooks 16, ordinary waste may pass in pipe 1 when hooks 16 are raised without causing plugging.

Finally, when the flush cycle is completed, hooks 16 are lowered into pipe 1. If any ordinary waste such as toilet tissue is not washed off prongs 17 by the washing action of orifices 28, the downward movement of prongs 17 will tend to suspend the waste in the water standing in pipe 1. This suspension of the waste has the advantage of soaking the waste and promoting disintegration. The ordinary waste passes the guard during subsequent flush cycles. Waste such as clothing, which does not soften and break up in water, remains hooked until it is removed manually by disengaging guard 5 from tee 2.

There are, of course, many alternate embodiments and modifications of the invention which are intended to be included within the scope of the following claims. For example, rather than a hydraulically operated piston to raise the prongs, an electric motor or other reciprocating mechanical apparatus may be employed.

What I claim is:

1. In combination with a flush toilet and a sewer pipe leading therefrom, an apparatus to catch articles improperly introduced into said sewer pipe, comprising:

(a) a magnetized prong having a hooked end pointed upstream in said pipe, said prong being slidable perpendicular to said pipe from a first position with said hooked end within a cross section of said pipe to a second position;

(b) means to slide said prong from said first position to said second position wherein said sliding means is activated by flushing said toilet; and (c) means to urge said prong from said second position back to said first position.

2. An apparatus as in claim 1, wherein said hooked end is within a cross section of said pipe when said prong is in said second position, said hooked end in said first position being at a relatively different depth in said pipe from said second position.

3. An apparatus as in claim 2, further comprising means to direct a spray of water parallel to and on an upstream side of said prong at a time when said toilet is flushing.

4. An apparatus as in claim 3 wherein said hooked end is at a greater depth in said pipe in said first position than in said second position.

5. An apparatus as in claim 1 wherein said prong sliding means is a cylinder attached perpendicular to said pipe having a piston connected to an opposite end of said prong.

6. An apparatus as in claim 5 wherein said means to urge said prong to said first position is a spring within said cylinder which is compressed when said prong is slid to said second position.

7. An apparatus as in claim 6 further comprising second and third prongs each having a hooked end positioned within said cross section of said pipe and an opposite end connected to said piston.

8. In combination with a flush toilet and a sewer pipe leading therefrom, an apparatus to catch articles improperly introduced into said sewer pipe, comprising:

(a) a cylinder, perpendicular to said pipe, having a base at one end connected to said pipe, said cylinder having a plate perpendicular to an axis of said cylinder;

(b) a piston slidable within said cylinder between said plate and an opposite end of said cylinder;

(c) a magnetized prong having an end connected to said piston, said prong extending from said piston, through an opening in said plate and an opening in said pipe, said prong further having a hooked end positioned within a cross section of said pipe and pointing upstream;

(d) means to direct a fluid into a chamber in said cylinder defined by said plate and said piston wherein said fluid directing means is activated by flushing said toilet;

(e) means to urge said piston toward said plate; and (f) means to divert said fluid out of said chamber.

9. An apparatus as in claim 8 wherein said fluid is diverted from said chamber at a slower rate than said fluid is directed into said chamber.

10. An apparatus as in claim 9 wherein a stroke of said piston slides said prong relative to said pipe from an extended position prior to a flush of said toilet to a retracted position while said toilet is flushing.

11. An apparatus as in claim 10 wherein said hooked end of said prong is within a cross section of said pipe during a stroke of said piston.

12. An apparatus as in claim 11 wherein said fluid comprises water and said means to divert said fluid comprises an orifice in said plate positioned on an upstream side of said prong.

13. An apparatus as in claim 12 wherein said means to divert said fluid in said chamber further comprises a water relief line from said chamber to said cylinder at a point below said plate, said water relief line having an adjustable valve.

14. An apparatus as in claim 13 further comprising a cap on said opposite end of said cylinder and an air relief line connected to said cylinder at a point between said cap and said piston, said air relief line having an adjustable valve.

15. An apparatus as in claim 14 wherein said means to urge said piston towards said plate comprises a spring in said cylinder between said cap and said piston.

16. An apparatus as in claim 15 wherein said base of said cylinder is threaded into said opening in said pipe.

* * * * *